US007137217B2

(12) United States Patent
Olson et al.

(10) Patent No.: US 7,137,217 B2
(45) Date of Patent: Nov. 21, 2006

(54) AUTO-LOADING FIREARM MECHANISMS AND METHODS

(75) Inventors: Douglas D. Olson, Vero Beach, FL (US); C. Reed Knight, Jr., Vero Beach, FL (US)

(73) Assignee: Knight's Armament Company, Titusville, FL (US)

( * ) Notice: Subject to any disclaimer, the term of this patent is extended or adjusted under 35 U.S.C. 154(b) by 0 days.

(21) Appl. No.: 10/855,660

(22) Filed: May 28, 2004

(65) Prior Publication Data

US 2005/0262750 A1 Dec. 1, 2005

(51) Int. Cl.
*F41A 3/10* (2006.01)

(52) U.S. Cl. ..... 42/15; 42/39.5; 42/7; 89/33.03; 89/161; 89/162

(58) Field of Classification Search ..... 42/15, 42/39.5; 89/33.03, 161, 162, 155
See application file for complete search history.

(56) References Cited

U.S. PATENT DOCUMENTS 4,872,391 A * 10/1989 Stoner ..... 89/155
5,827,991 A * 10/1998 Predazzer ..... 89/161
6,343,536 B1 * 2/2002 Rossier et al. ..... 89/161
6,681,677 B1 * 1/2004 Herring ..... 89/33.14

FOREIGN PATENT DOCUMENTS

FR 2507301 A1 * 12/1982

* cited by examiner

*Primary Examiner*—Michelle Clement
*Assistant Examiner*—Stewart Knox
(74) *Attorney, Agent, or Firm*—Brian S. Steinberger; Law Offices of Brian S. Steinberger, P.A.

(57) ABSTRACT

Automatic and semi-automatic firearms of remarkably reduced mass yet capable of long-range accuracy because of unique recoil reduction are characterized by (A) a temporary combination of a barrel, an integral breech and a separable chamber that in operation of the firearm is moved by a compressed spring distally before and while a chambered cartridge is fired, (B) run-out of such temporary operative combination diminishes firearm recoil, (C) recoil of the temporary operative combination recompresses the spring and (D) the separable chamber is loaded with a round while spatially separated from the breech and barrel.

9 Claims, 21 Drawing Sheets

AUTO-LOADING FIREARM MECHANISMS AND METHODS

BACKGROUND OF THE INVENTION

1. Field of the Invention

This invention relates broadly to improvements in mechanisms and methods for the auto-loading class of firearms, especially recoil-operated, automatic and semi-automatic rifles and machine guns. More particularly, it concerns improved auto-loading firearms comprising cartridge loading/firing mechanisms of critically reduced mass while possessing long-range accuracy as compared to related prior known auto-loading firearms and related methods.

2. Description of the Prior Art

There is a need for auto-loading firearms with reduced mass to allow the gunner to have a smaller load to carry. Most auto-loading battle firearms have either gas operation or recoil operation. These mechanisms require putting into motion a finite amount of mass that then uses associated energy to eject the fired cartridge case, cock the hammer, load the incoming cartridge and lock the bolt in place for the subsequent shot. For example, in the following well-known, gas-operated rifles, their reciprocating masses are: for the SR-25—about 27 oz., for the M16/M4—about 17 oz. and for the Stoner LMG—about 25 oz.

Other prior known gas-operated rifles will have similar or slightly heavier reciprocating masses while recoil-operated firearms will have considerably more mass put in motion. In contrast to the prior known gas-operated and recoil-operated firearms, the present invention provides a new class of firearms comprising cartridge loading/firing mechanisms that eliminate the prior required bolts and the bolt carrier/op rods. Hence, the new firearms of the invention are relatively reduced in mass by the elimination in the weight of these previously required components.

As stated in U.S. Pat. No. 6,343,536, lightweight portable automatic firearms that are capable of accurately firing a projectile over a significant distance would provide a decisive tactical advantage. However, existing firearms that are effective at long ranges, e.g., up to 2,000 meters, are too bulky and heavy to be easily portable. Further, this reference confirms what has been said above that the accuracy of firearms at long range depends on the ability of the firearm to manage its recoil when it is fired and then discloses a scheme to minimize firearm recoil by providing the firearm with a barrel assembly that can move forward during initial firing of the firearm to counteract recoil. This scheme enables firearms to be constructed with reduced weight having long-range accuracy comparable to heavy weight conventional firearms. However, the firearms constructed in accordance with U.S. Pat. No. 6,343,536 require a buffer device that per se adds weight to the firearm. The present invention further improves the art for auto-loading firearm construction using a new "fire on runout" scheme by eliminating the need for a buffer device and enables firearm operation with "cased telescoped rounds".

OBJECTS

A principal object of the invention is the provision of improvements in construction of auto-loading firearms comprising cartridge loading/firing mechanisms of critically reduced mass while possessing long-range accuracy as compared to prior known auto-loading firearms.

Another object is the provision of improved firearms comprising cartridge loading/firing mechanisms of critically reduced mass while possessing long-range accuracy without need to include a buffer device to dampen the "runout" of the firearm's barrel assembly.

Further objects include:

(1) The provision of a new design for lightweight portable automatic firearms that can effectively be used to (a) fire "cased telescoped rounds" and (b) load cartridges from a variety of storage devices, e.g., magazines, belts and links.

(2) The provision of a unique breech/chamber system adaptable for the creation of a variety of new lightweight portable automatic firearms.

Other objects and further scope of applicability of the present invention will be apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The stated objects are accomplished in accordance with the invention by providing a firearm mechanism of reduced mass yet capable of long range accuracy comprising in combination: a) a barrel defined by a proximal end, a distal end and a bore, b) a breech attached to the proximal end forming an operative combination of the barrel and the breech, c) a receiver mounting the operative combination for movement along a longitudinal axis between a proximal extremity and a distal extremity, d) a chamber structured to chamber cartridges and e) transport means carried by the receiver to move the chamber into the breech while the operative combination is in transit from the proximal extremity to the distal extremity and to move the chamber out of the breech while the operative combination is in transit from the distal extremity to the proximal extremity.

In preferred embodiments of the invention the firearm mechanism comprises: 1) a barrel defined by a proximal end, a distal end and a bore, 2) a cartridge storage means for containing and dispensing cartridges, 3) a chamber structured to receive cartridges dispensed from the cartridge storage means, 4) a breech attached to said proximal end forming a permanent operative combination of the barrel and the breech, 5) the breech being structured to operatively receive the chamber to thereby provide a temporary operative combination of the barrel, the breech and the chamber, 6) a receiver mounting the permanent operative combination for movement along a longitudinal axis between a proximal extremity and a distal extremity, 7) transport means carried by the receiver to move the chamber into the breech while the permanent operative combination moves along the longitudinal axis toward the distal extremity thereby creating the temporary operative combination and to move the chamber out of the breech while the temporary operative combination is in motion along the longitudinal axis toward the distal extremity, 8) spring means structured to bias the permanent operative combination distally along the longitudinal axis and to be compressed by proximal movement of the permanent operative combination and 9) trigger means to cause discharge of chambered cartridges with a predetermined delay after movement of the temporary operative combination toward the distal extremity has commenced.

In addition to the eight components of the new firearms delineated above, they include as cooperative components a sear, an extractor, a striker, a striker sear, a cartridge case ejector and a breech sear. Further, they can include additional conventional items including a charging handle, a stock, sights and the like. Also, the cartridge storage means advantageously is a magazine, but may be a belt or link feed, e.g., see U.S. Pat. No. 6,681,677 that is incorporated herein by reference.

The stated objects are further accomplished in accordance with the invention by providing a new method of firing an automatic or semi-automatic firearm comprising a storage means containing cartridges, a spring means, a chamber, an operative combination of a barrel and a breech structured to operatively receive and release the chamber.

This new method comprises the steps of a) separating the chamber from the breech, b) discharging an empty cartridge case from the chamber, c) loading a cartridge from the storage means into the empted chamber, d) moving the cartridge loaded chamber into the breech while the operative combination of the barrel and the breech moves along a longitudinal axis toward a distal extremity forming a temporary combination of the barrel, breech and chamber, e) firing the cartridge while the distal movement of the temporary combination is in progress, f) causing the spring means to move the temporary operative combination distally along the longitudinal axis to the distal extremity and g) compressing the spring means via proximal movement of the temporary operative combination resulting from said cartridge firing.

In preferred embodiments of this new method, the chamber is moved laterally of the breech during the separation from the breech and/or the chamber is moved at least partially proximally of the breech during the separation from the breech.

In order to elucidate the improvements in firearms provided by the invention, the following text provides a description of their operation.

1. The invention's mechanism has a barrel and breech that travel together. A chamber is cycled so that, after sear release, the incoming cartridge is loaded while the chamber is separated from the barrel and breech. The breech actually strips the cartridge from the magazine and loads it into the chamber. The chamber then follows a cam path that lifts the chamber into alignment with the bore of the barrel. At that point the breech, barrel, chamber and cartridge are all traveling distally as an operative unit. The firing pin then is released to strike the primer after a brief travel of the operative unit.

2. The cartridge's propellant is ignited by the primer and the gasses propel the projectile from the barrel. The force created by accelerating the projectile is transferred into the operative combination of barrel, breech, chamber and empty cartridge case, reversing its forward motion and causing it to recoil to the rear.

3. The chamber is withdrawn from the barrel and the receiver then stops the chamber's rearward travel. The barrel and breech continue traveling to the rear carrying with it an extractor that clears the cartridge case from the chamber. When the cartridge case clears the back of the chamber, a fixed ejector strikes the cartridge case discharging it from the firearm. The recoil spring is compressed during the rearward travel and eventually stops the breech and barrel.

4. The breech and barrel return to the seared position behind the incoming cartridge from the cartridge storage means.

BRIEF DESCRIPTION OF THE DRAWINGS

A more complete understanding of the invention can be obtained by reference to the accompanying drawings that for simplicity do not depict a charging handle, stock, sights, etc. that would normally be on the firearm. In these drawings.

DESCRIPTION OF THE PREFERRED EMBODIMENTS

Figure 1:
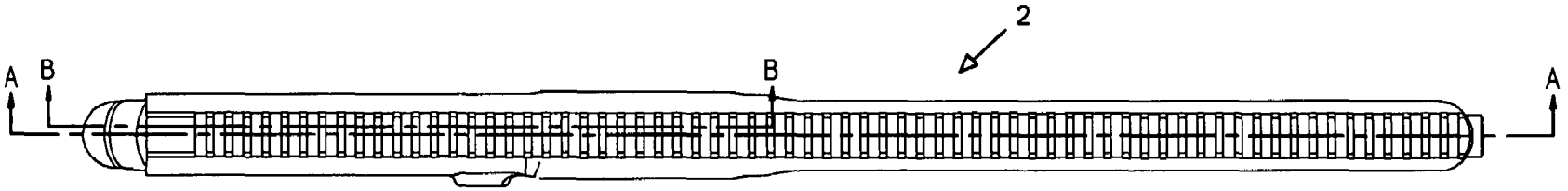
FIG. 1 is a top view of a firearm constructed in accordance with the invention with its components in position 1, i.e., with breech seared up, the safety on and the trigger forward.
Figure 2:
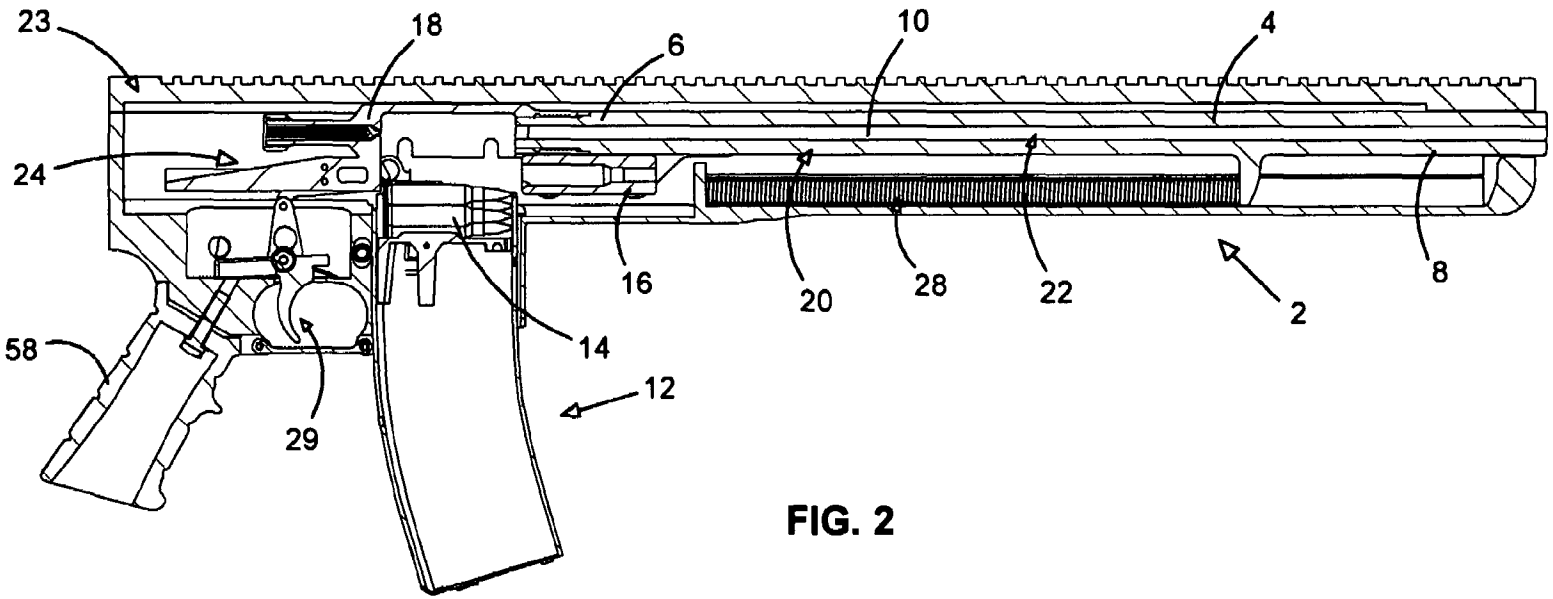
FIG. 2 is a sectional lateral view of the firearm taken on the section A—A of FIG. 1.
Figure 3:
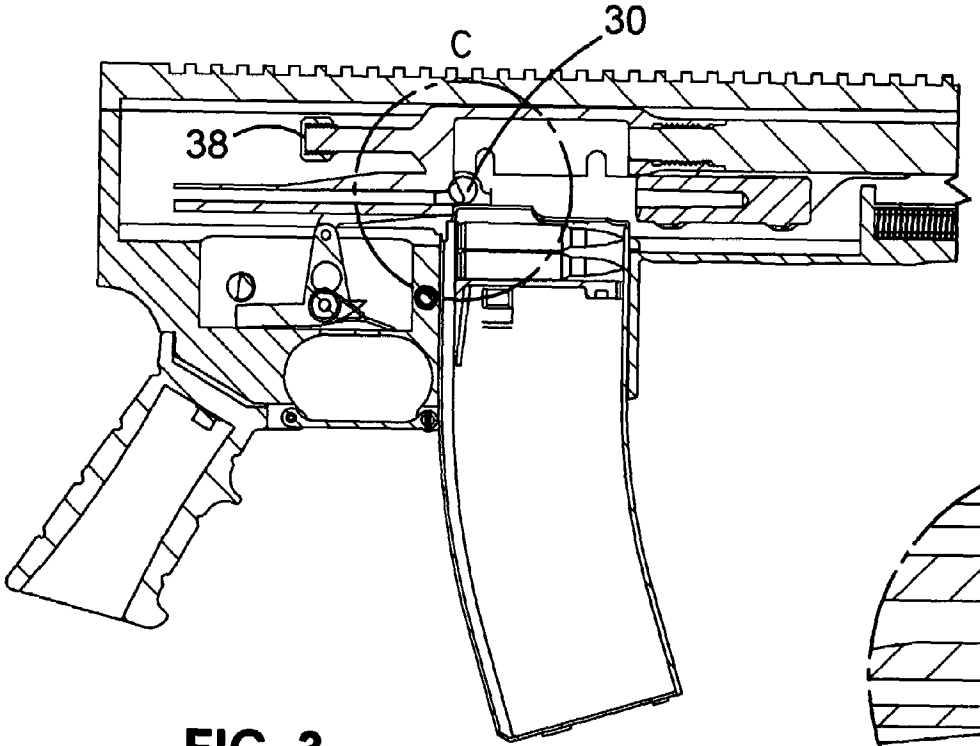
FIG. 3 is an enlarged fragmented sectional lateral view of the firearm taken on section B—B of FIG. 1.
Figure 4:
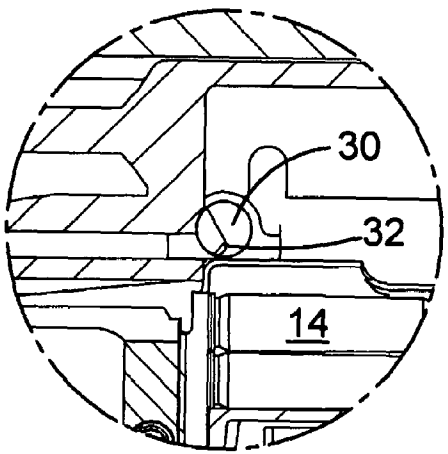
FIG. 4 is a sectional lateral detail view of the firearm defined by the circular area C shown in FIG. 3.
Figure 5:
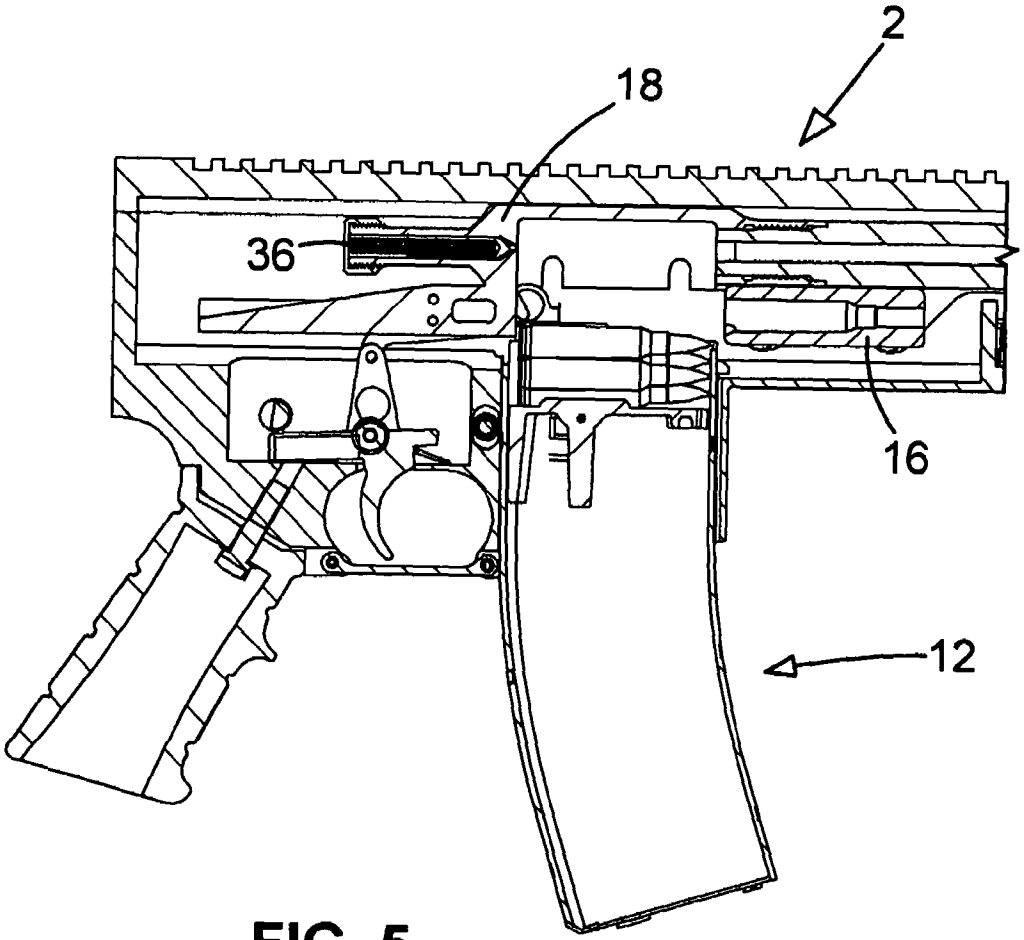
FIG. 5 is an enlarged fragmented sectional lateral view of the firearm taken on the section A—A of FIG. 1.
Figure 6:
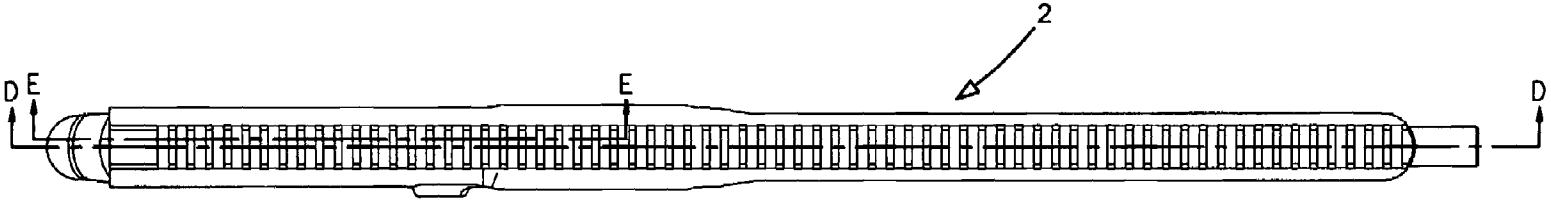
FIG. 6 is a top view of the firearm with its components in position 2, i.e., with the sear rotated to align with a slot in the breach and in the process of loading the incoming round into the chamber.
Figure 15:
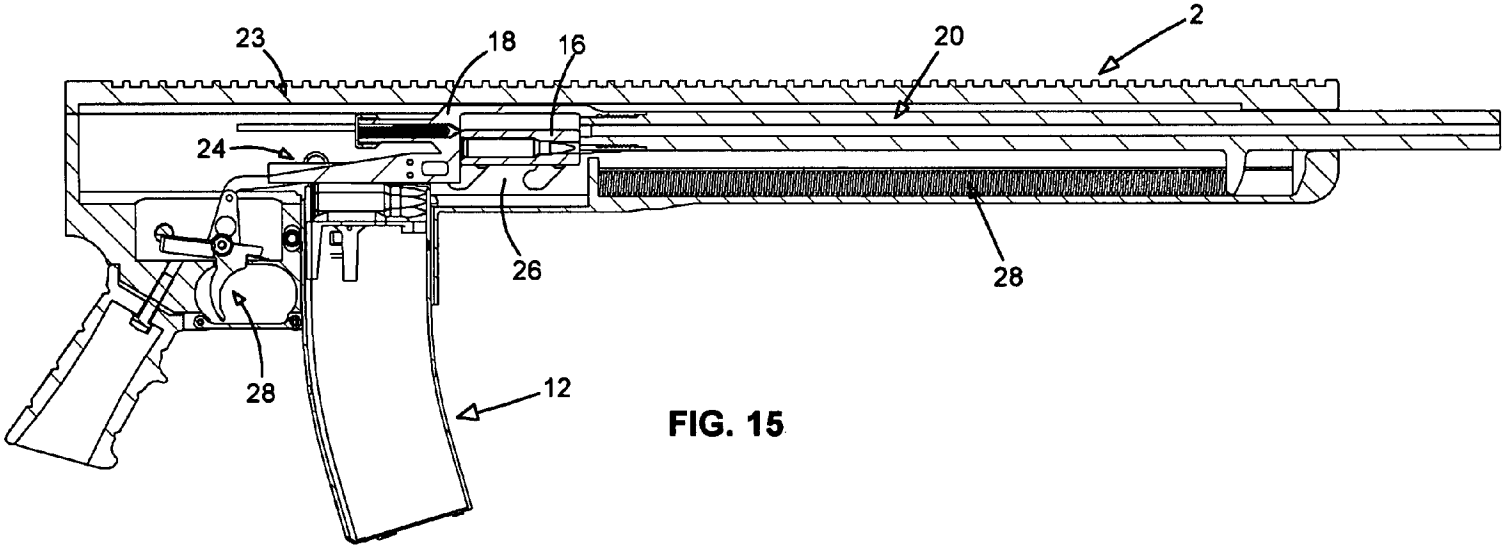
FIG. 15 is a sectional lateral view of the firearm taken on the section I—I of FIG. 14.
Figure 16:
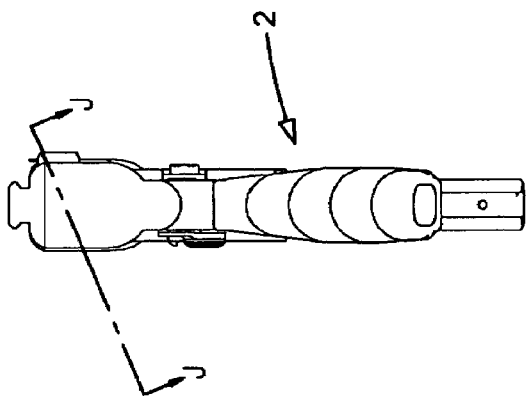
FIG. 16 is a rear view of the firearm in position 4.
Figure 17:
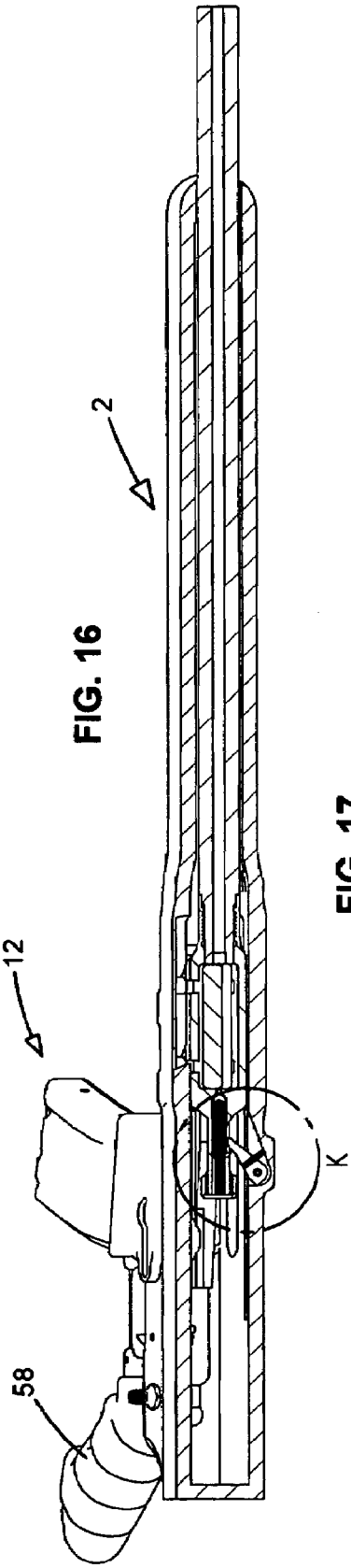
FIG. 17 is downward sectional view of the firearm taken on the section J—J of FIG. 16.
Figure 21:
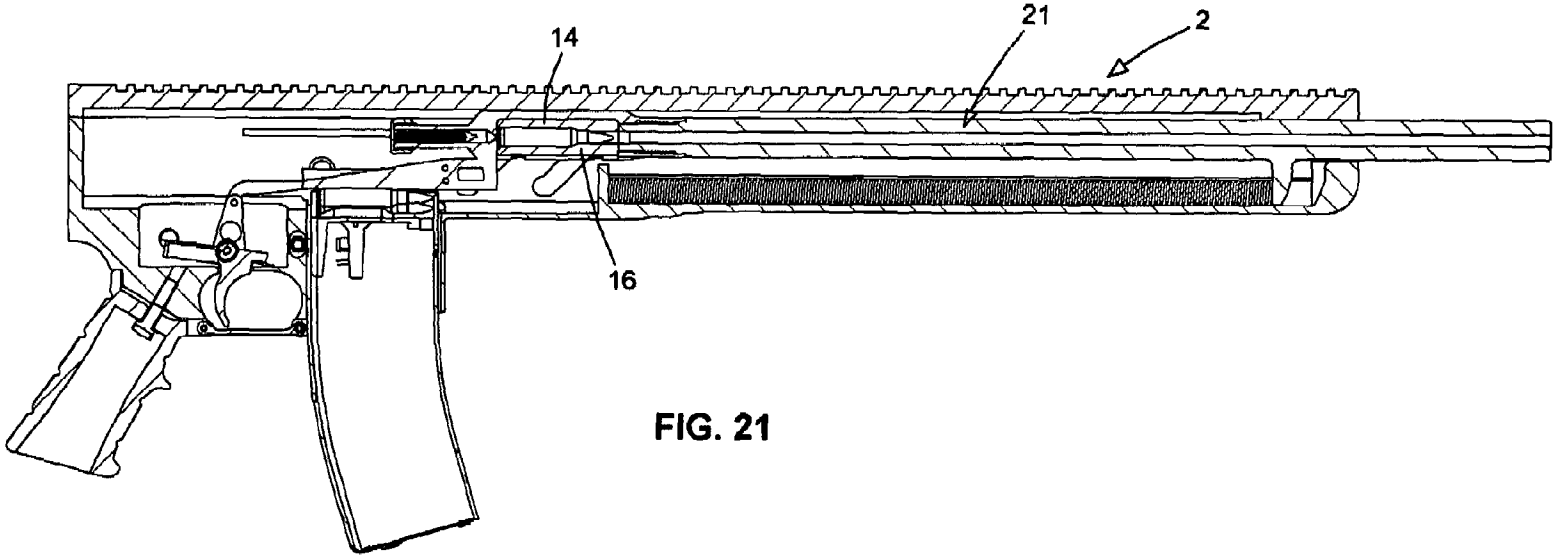
FIG. 21 is a sectional lateral view of the firearm taken on the section L—L of FIG. 20.
Figure 22:
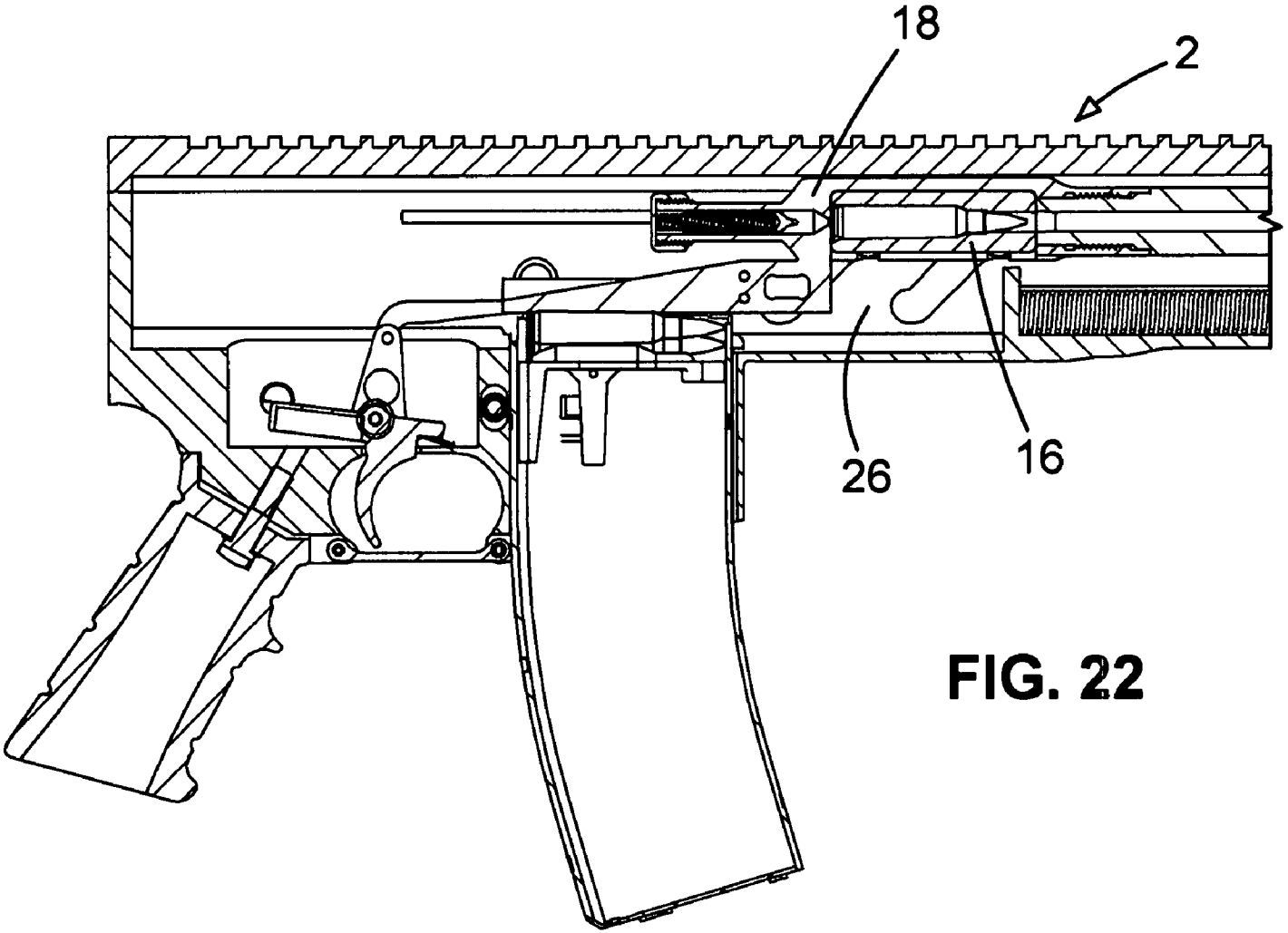
FIG. 22 is an enlarged fragmented view of the left hand portion of FIG. 21.
Figure 23:
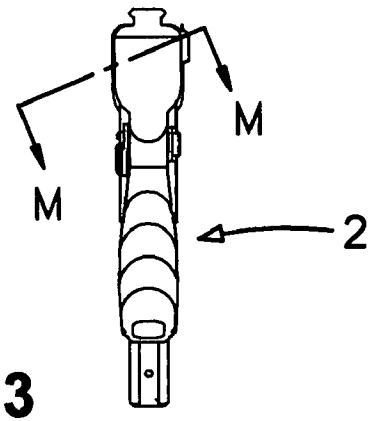
FIG. 23 is a rear view of the firearm position 5.
Figure 24:
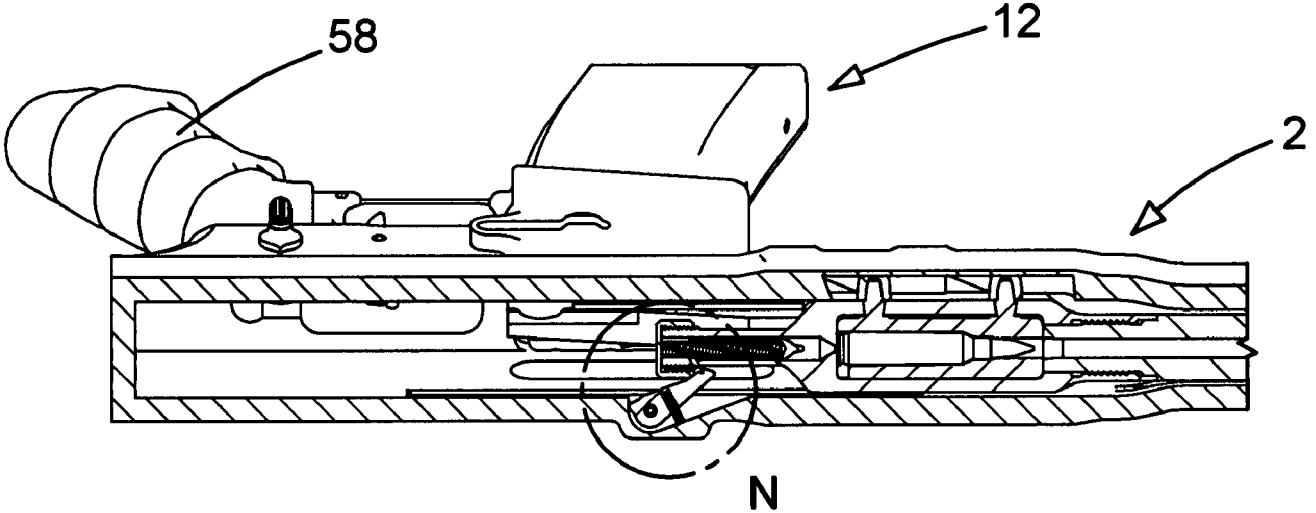
FIG. 24 is downward partial sectional view of the firearm taken on the section M—M of FIG. 23.
Figure 27:
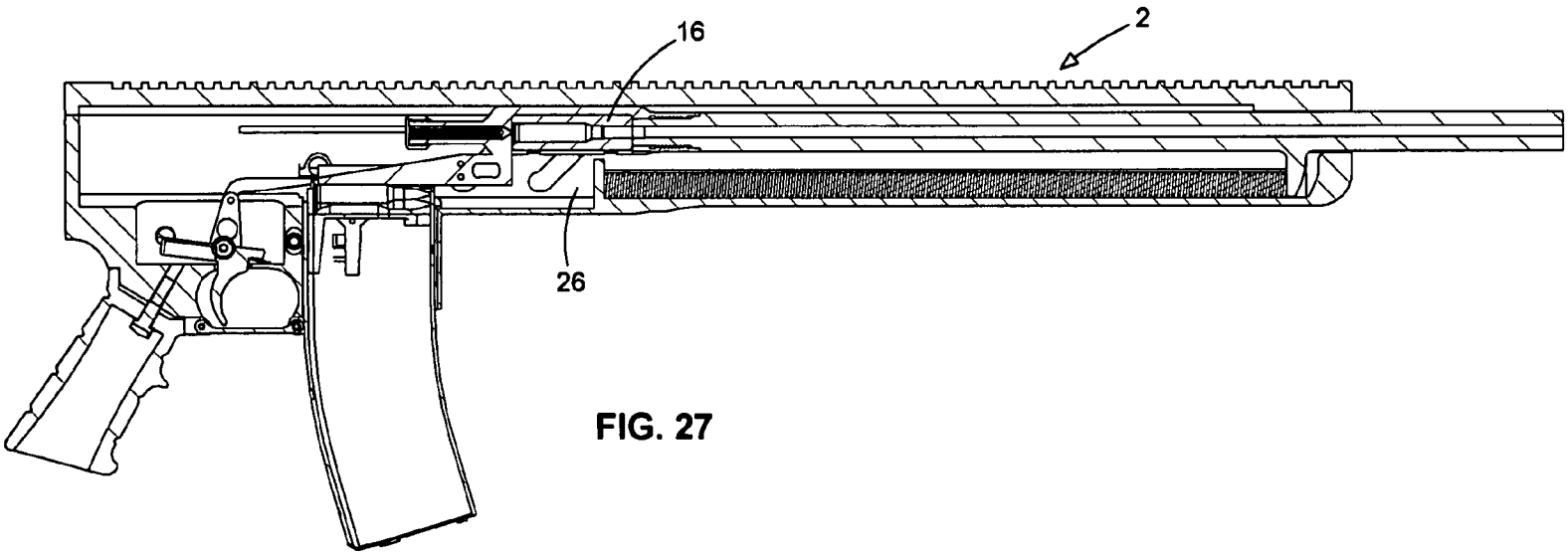
FIG. 27 is a sectional lateral view of the firearm taken on the section 0—0 of FIG. 26.
Figure 28:
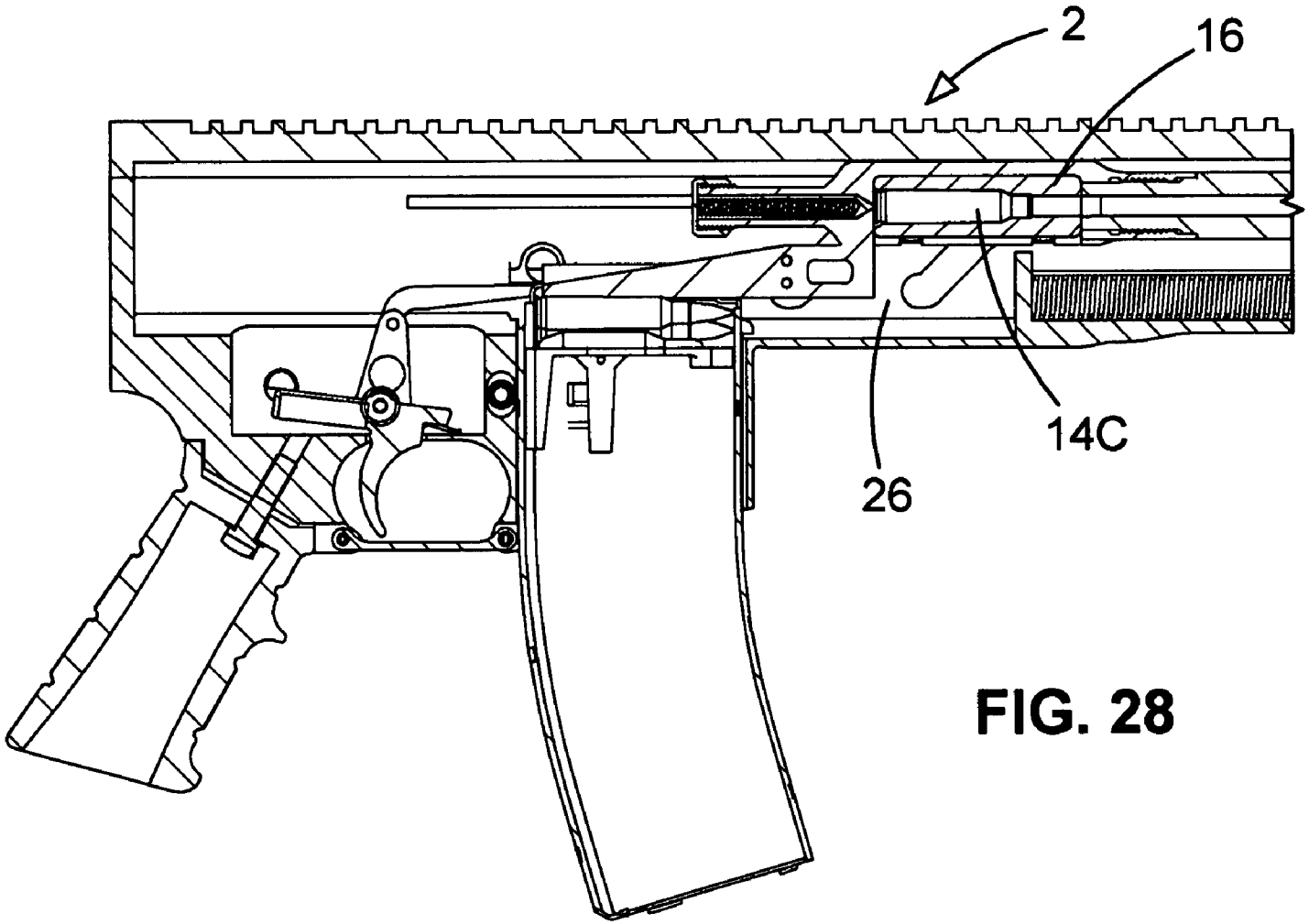
FIG. 28 is an enlarged fragmented view of the left hand portion of FIG. 27.
Figure 29:
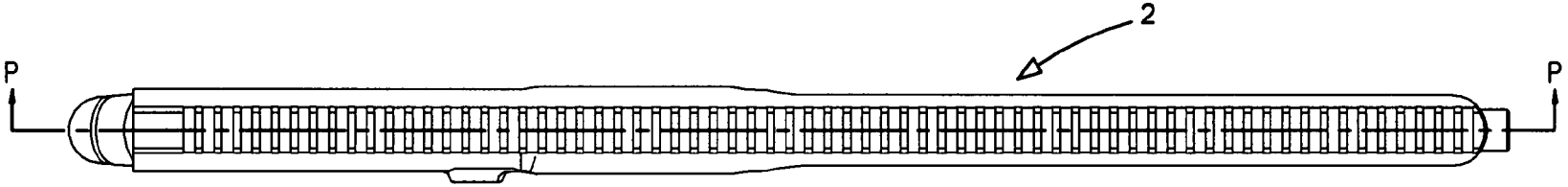
FIG. 29 is a top view of the firearm with its components in position 7, i.e., the emptied cartridge case strikes the sear that ejects it from the firearm.

Referring in detail to the drawings beginning with FIGS. 1–3, the firearm 2 of the invention comprises a unique combination of eight components namely:

1. a barrel 4 defined by a proximal end 6, a distal end 8 and a bore 10, 2. a magazine 12 for containing and dispensing cartridges 14, 3. a chamber 16 structured to chamber cartridges 14 dispensed from the magazine 12, 4. a breech 18 attached to proximal end 6 of barrel forming a permanent operative combination 20 structured to operatively receive chamber 16 whereby the breech 18, the barrel 4 and the chamber 16 provide a temporary operative combination 21 (see FIG. 21), 5. a receiver 23 mounting said permanent operative combination 20 and temporary operative combination 21 for movement along said longitudinal axis 22 between a proximal extremity as shown in FIG. 2 and a distal extremity as shown in FIG. 27, 6. transport means 24 comprising a cam 26 (see FIG. 15) carried by the receiver 23 to move the chamber 16 into and out of breech 18 (compare FIG. 2 with FIG. 21), 7. spring means 28 structured to bias operative combination 20 distally along the longitudinal axis 22 and to be compressed by proximal movement of the operative combinations 20 & 21 from the distal extremity (see FIG. 27) and ultimate movement of permanent operative combination 20 to the proximal extremity (see FIG. 2), and 8. trigger means 29 to cause discharge of the chambered cartridges 14 (see FIG. 21) with a predetermined delay after movement of said temporary operative combination 21 toward the distal extremity has commenced (compare FIG. 15 with FIG. 21).

Figure 18:
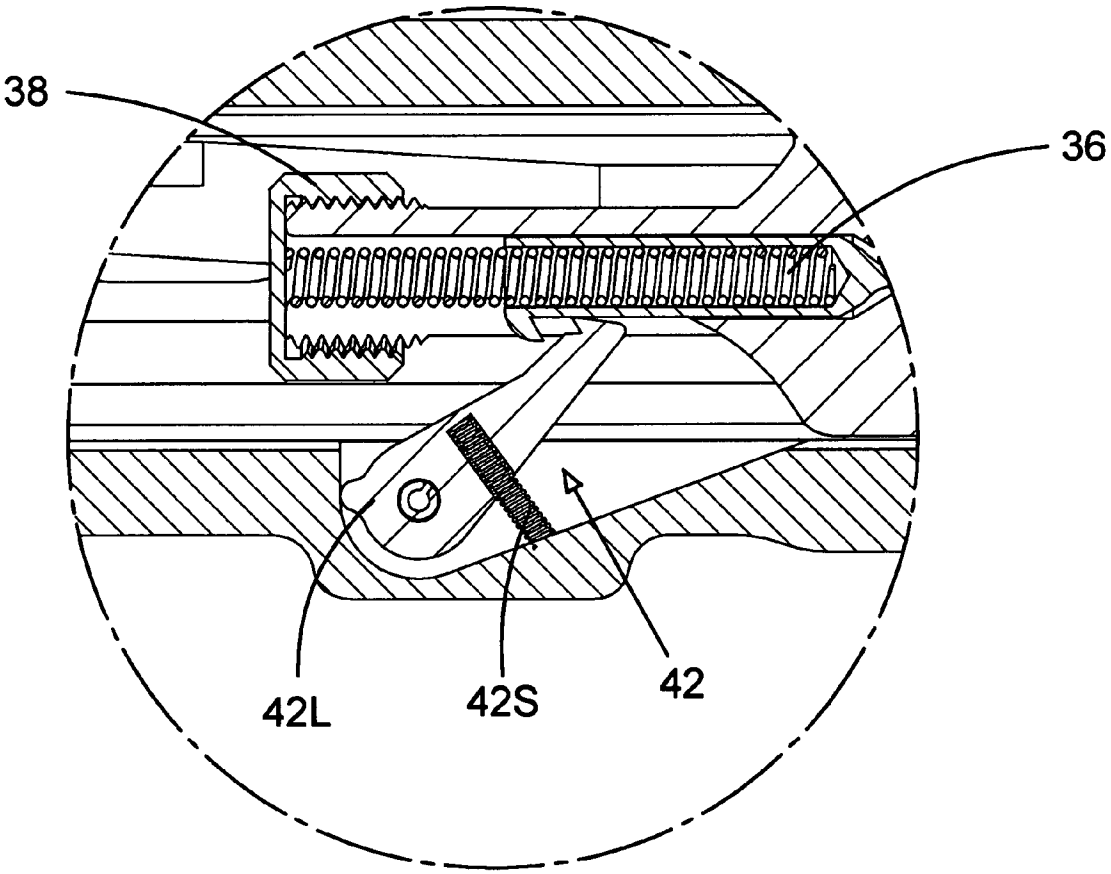
FIG. 18 is an enlarged sectional detail view of the firearm defined by the circular area K shown in FIG. 17.
Figure 19:
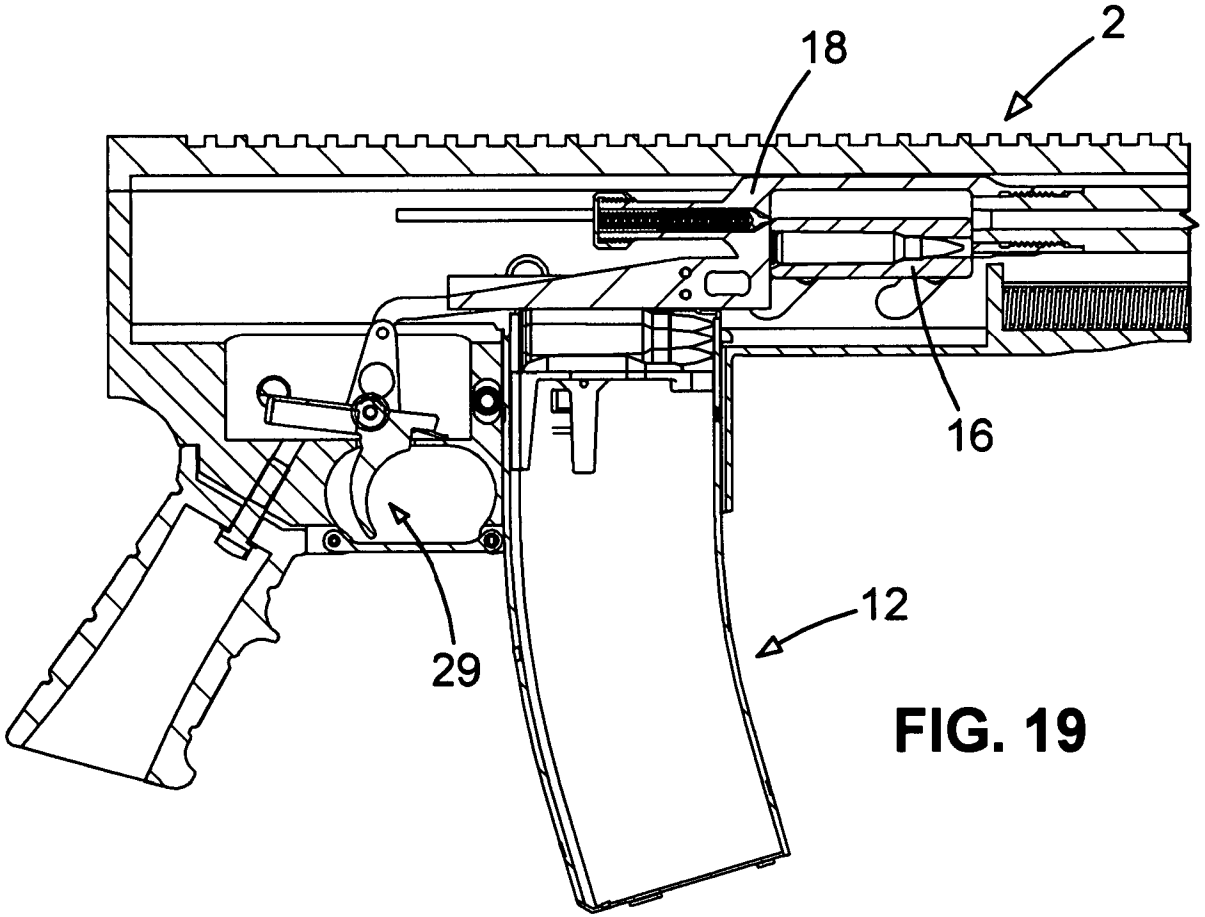
FIG. 19 is an enlarged fragmented view of the left hand portion of FIG. 15.
Figure 20:
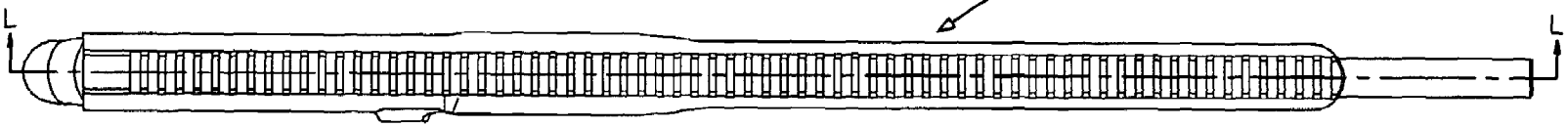
FIG. 20 is a top view of the firearm with its components in position 5, i.e., the chamber is fully moved into the breech and the firing pin is fully cocked with the cocking lever being lifted to release the firing pin.
Figure 25:
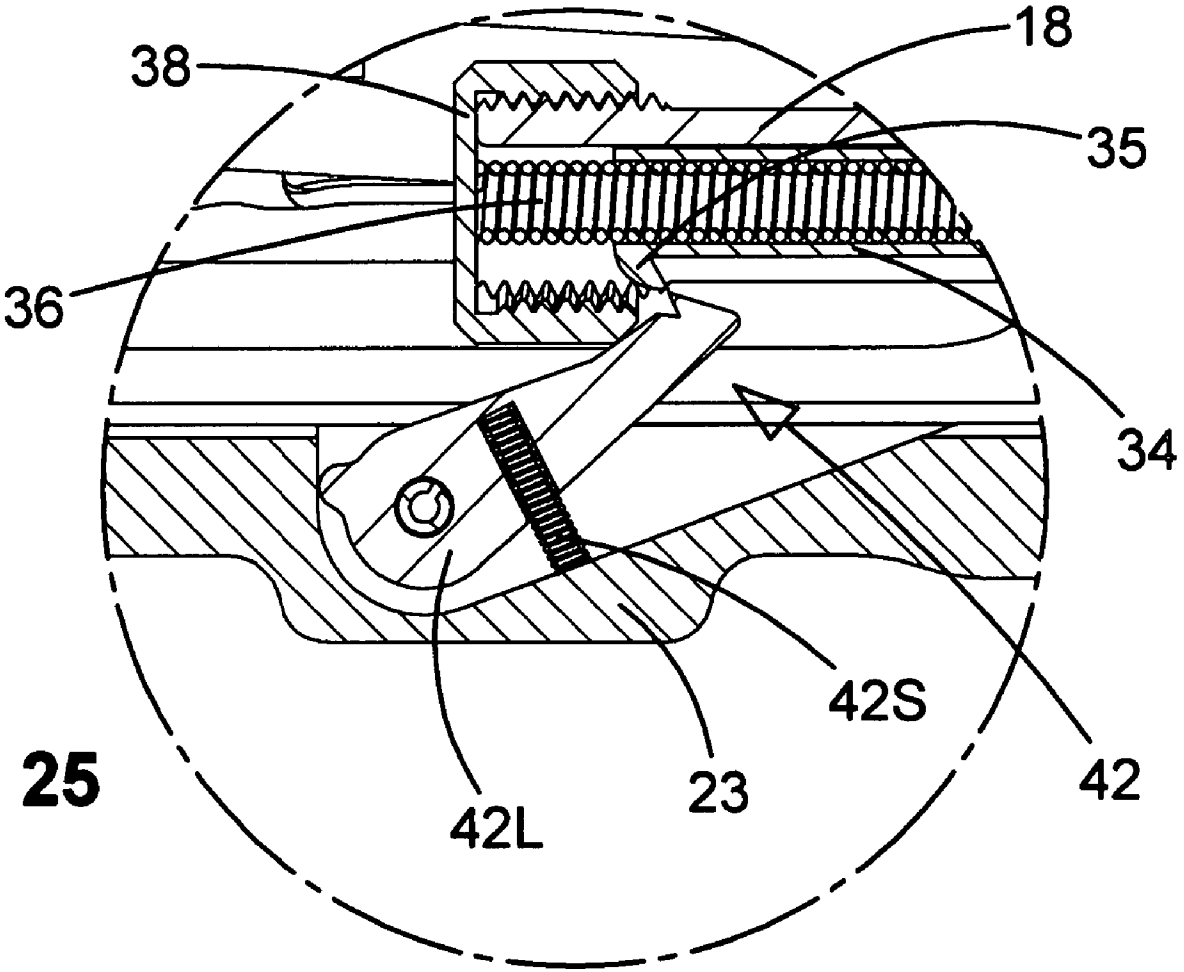
FIG. 25 is a sectional detail view of the firearm defined by the circular area N shown in FIG. 24.
Figure 26:
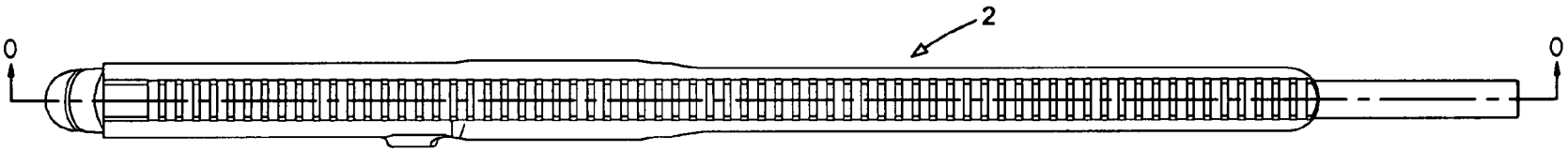
FIG. 26 is a top view of the firearm with its components in position 6, i.e., the round has been fired, the bullet has exited the bore and the combination of the barrel, breech and chamber have reached the distal position where it changes travel direction.
Figure 32:
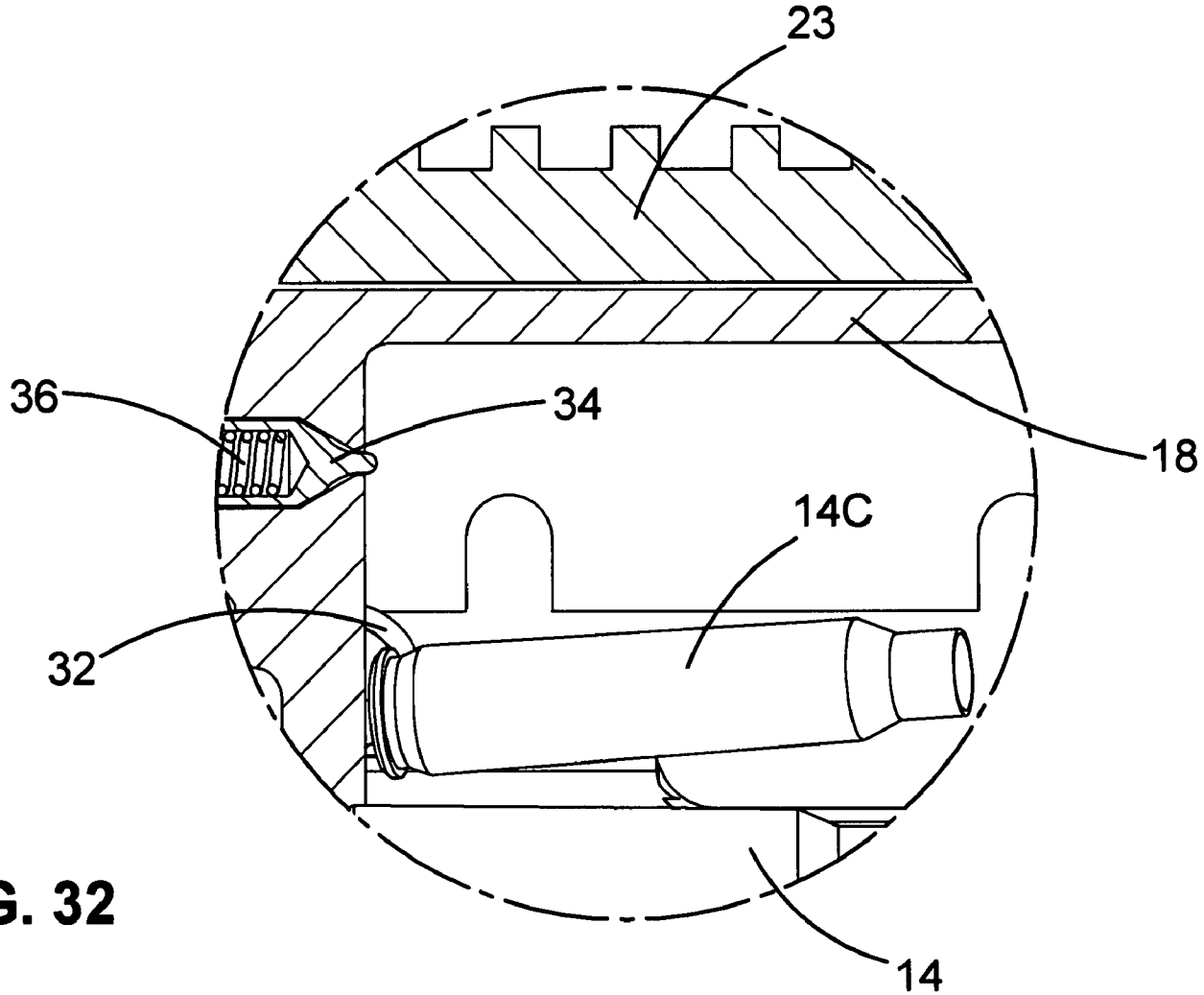
FIG. 32 is an enlarged sectional detail view of the firearm defined by the circular area Q shown in FIG. 31.

In addition, the firearm 2 comprises as cooperative components a sear 30 (FIG. 3) that has an ejector surface 32 to eject empty cartridge casings 14C (FIG. 32), a striker 34 (FIG. 25), striker spring 36 (FIG. 2), a breach end cap 38 (FIG. 3) that retains the striker spring 36 and striker cocking means 42 (FIG. 18) comprising lever 42L and spring 42S. The lever 42L slides along the striker 34 to grab the striker proximal end hook 35 (FIG. 25) to cock the striker 34 and subsequently the breach end cap 38 acts as a sear that lifts the lever 42L to release it from the striker proximal end hook 35.

Figure 31:
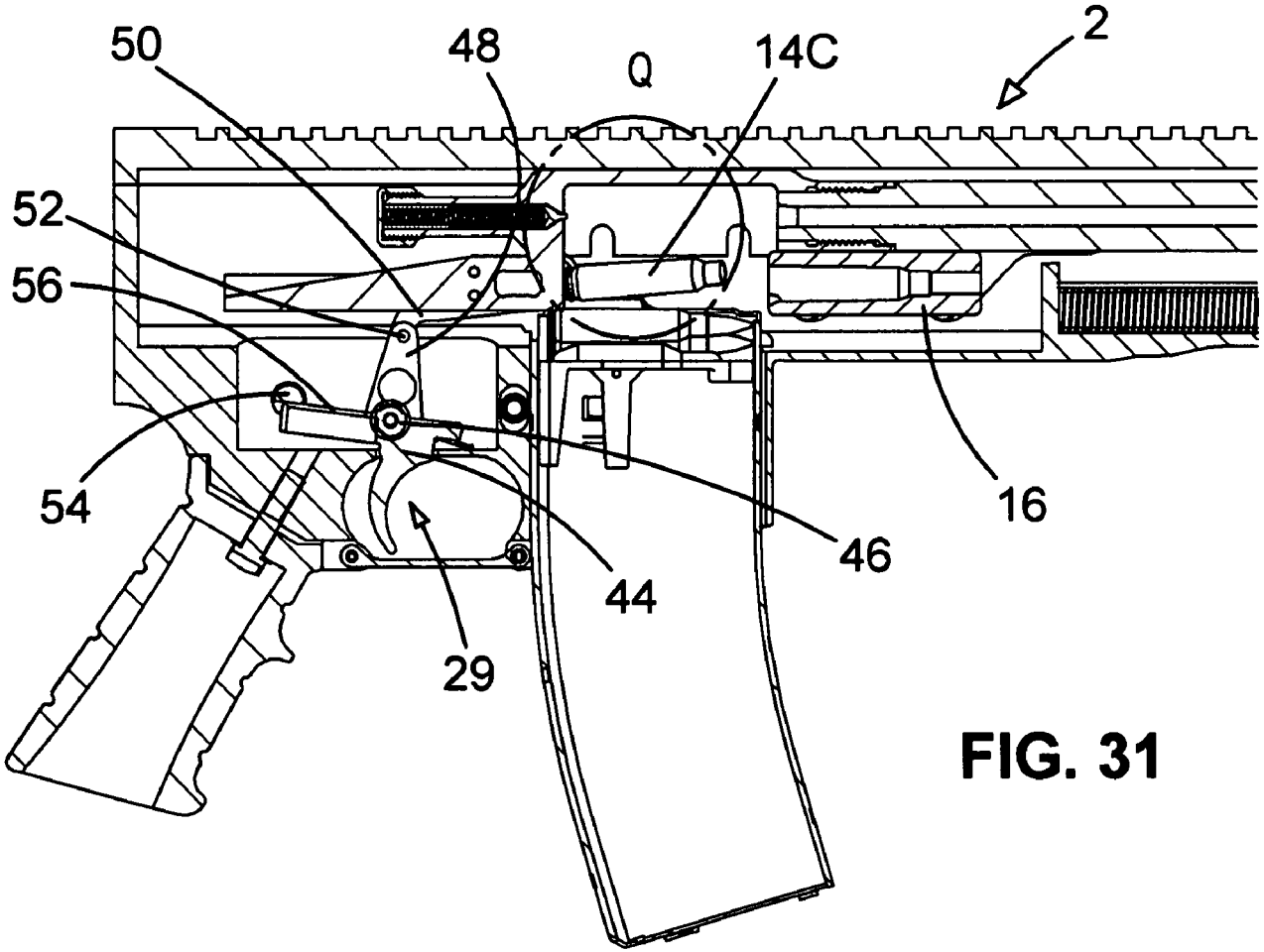
FIG. 31 is an enlarged fragmented view of the left hand portion of FIG. 30.

Further the trigger means 29 (see FIG. 31) comprises trigger 44, trigger pivot 46, lever arm 48, sear actuation lever 50 connected to lever arm by pin 52, a safety 54 and safety engagement lug 56. The lever 50 causes the sear 30 to rotate when trigger 44 is pulled.

Additionally, the firearm 2 comprises a handle 58.

Figure 7:
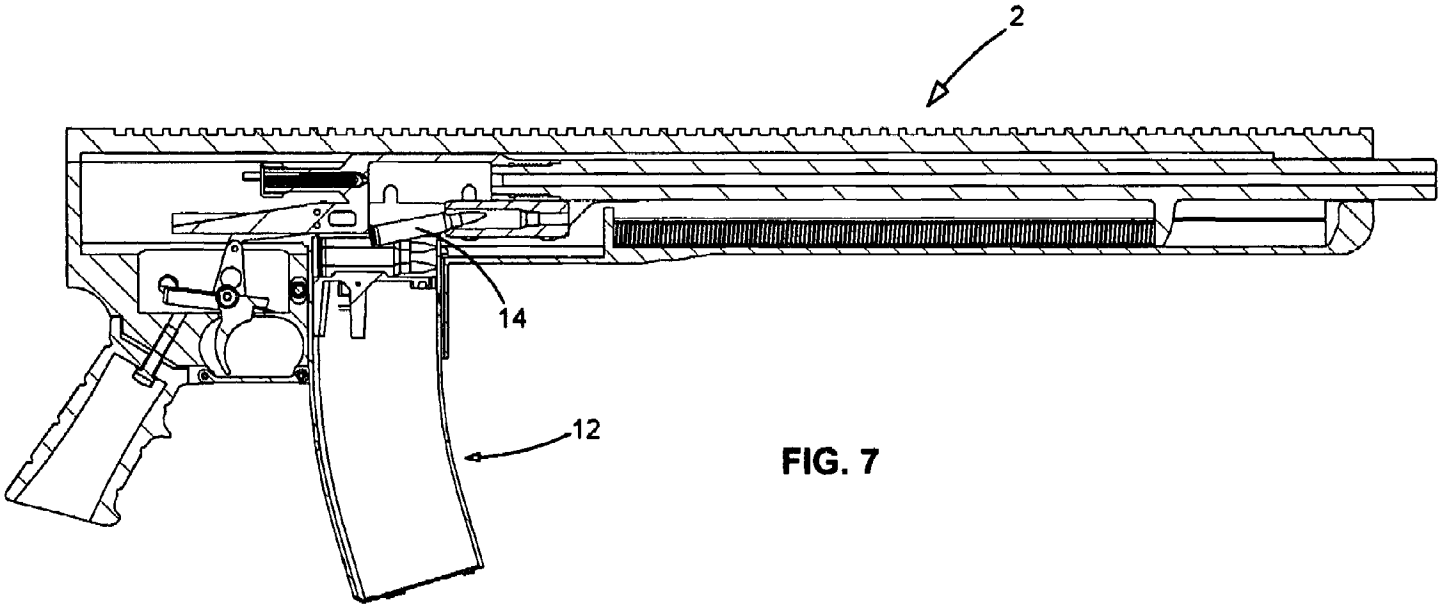
FIG. 7 is a sectional lateral view of the firearm taken on the section D—D of FIG. 6.
Figure 8:
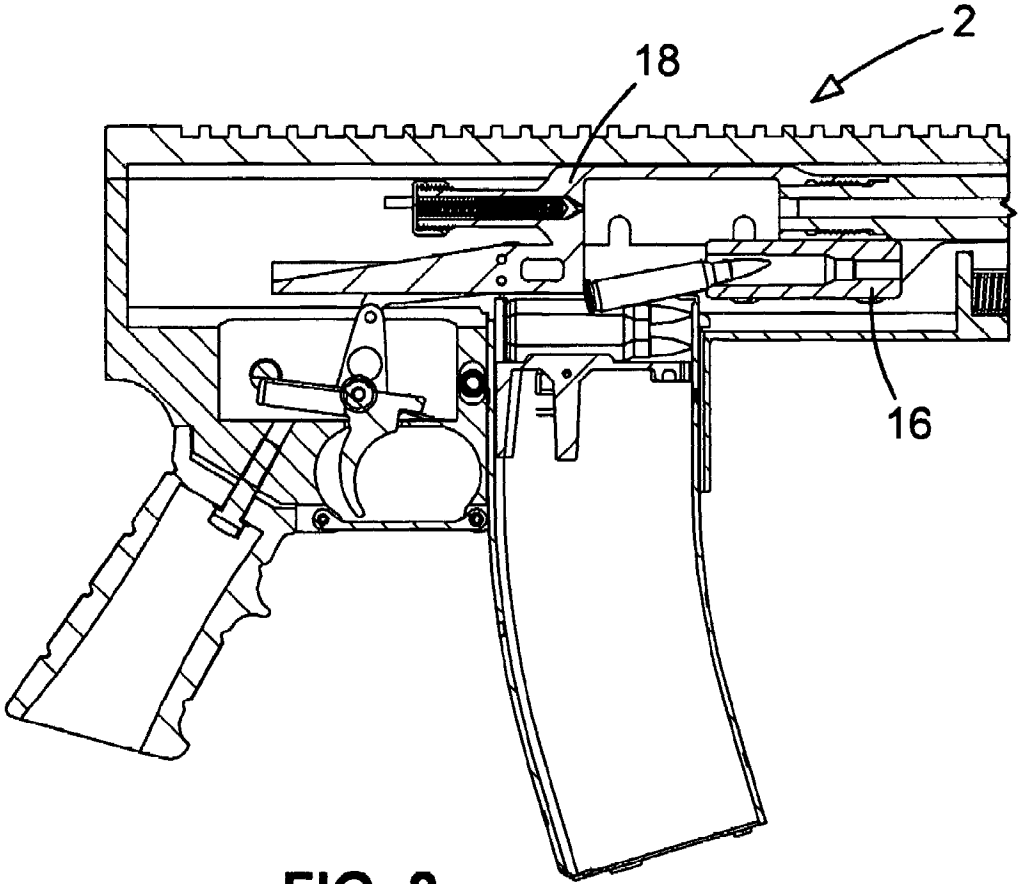
FIG. 8 is an enlarged fragmented sectional lateral view of the firearm taken on the section D—D of FIG. 1.
Figure 9:
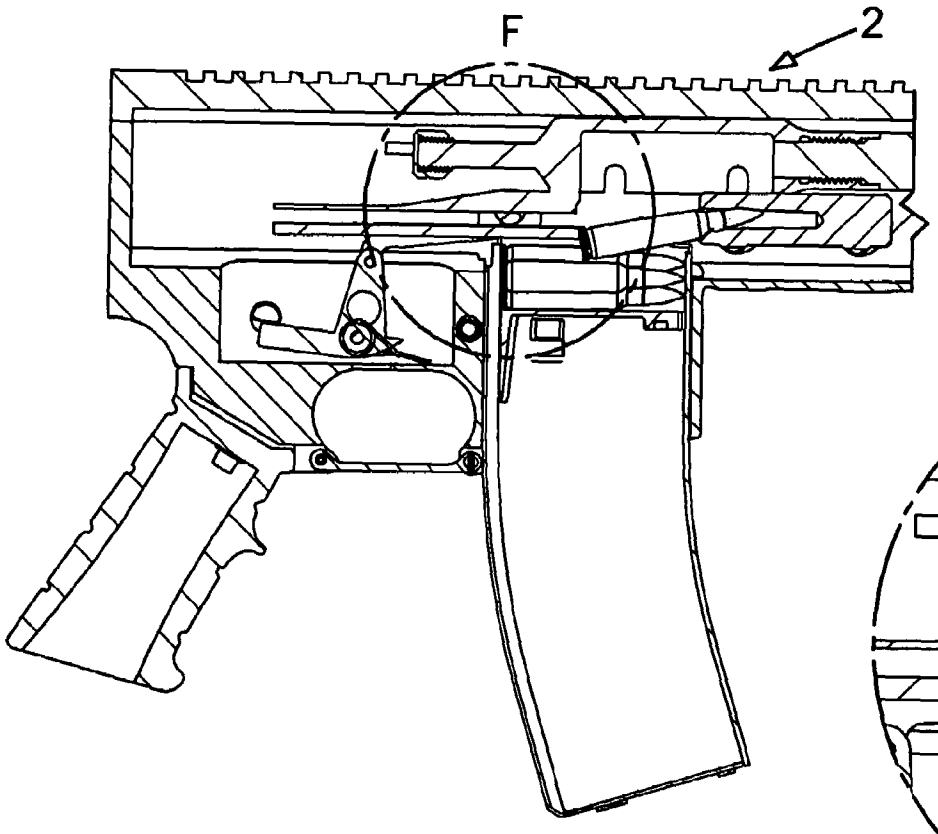
FIG. 9 is an enlarged fragmented sectional lateral view of the firearm taken on the section E—E of FIG. 1.
Figure 10:
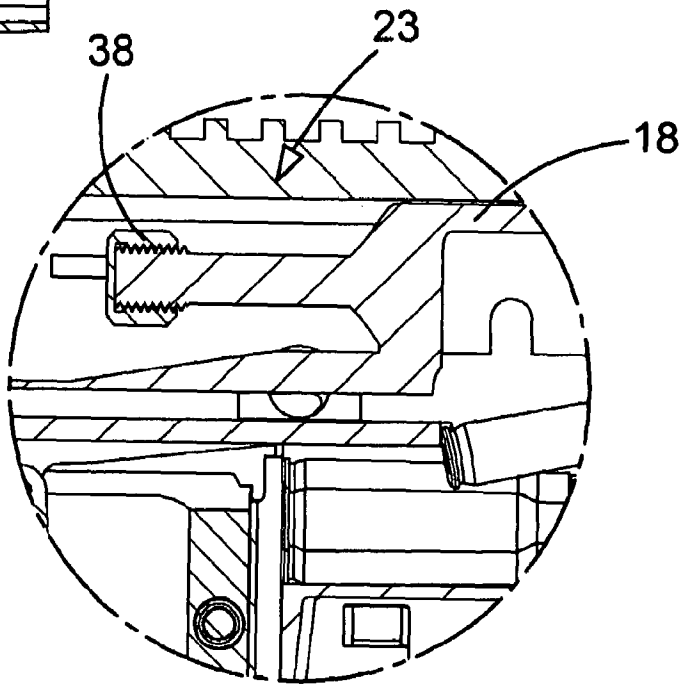
FIG. 10 is a sectional lateral detail view of the firearm defined by the circular area F shown in FIG. 9.
Figure 11:
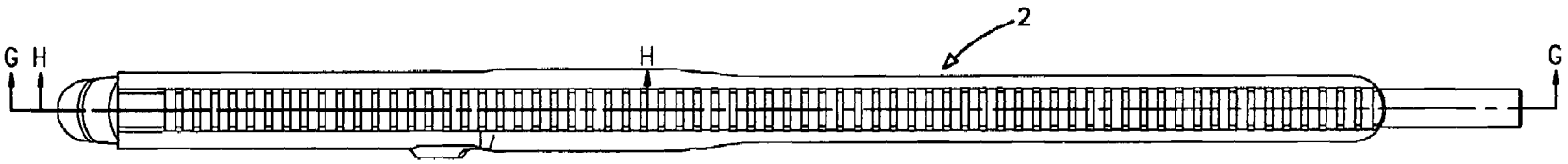
FIG. 11 is a top view of the firearm with its components in position 3, i.e., the incoming round is fully chambered and the chamber is ready to be lifted into the breech.
Figure 12:
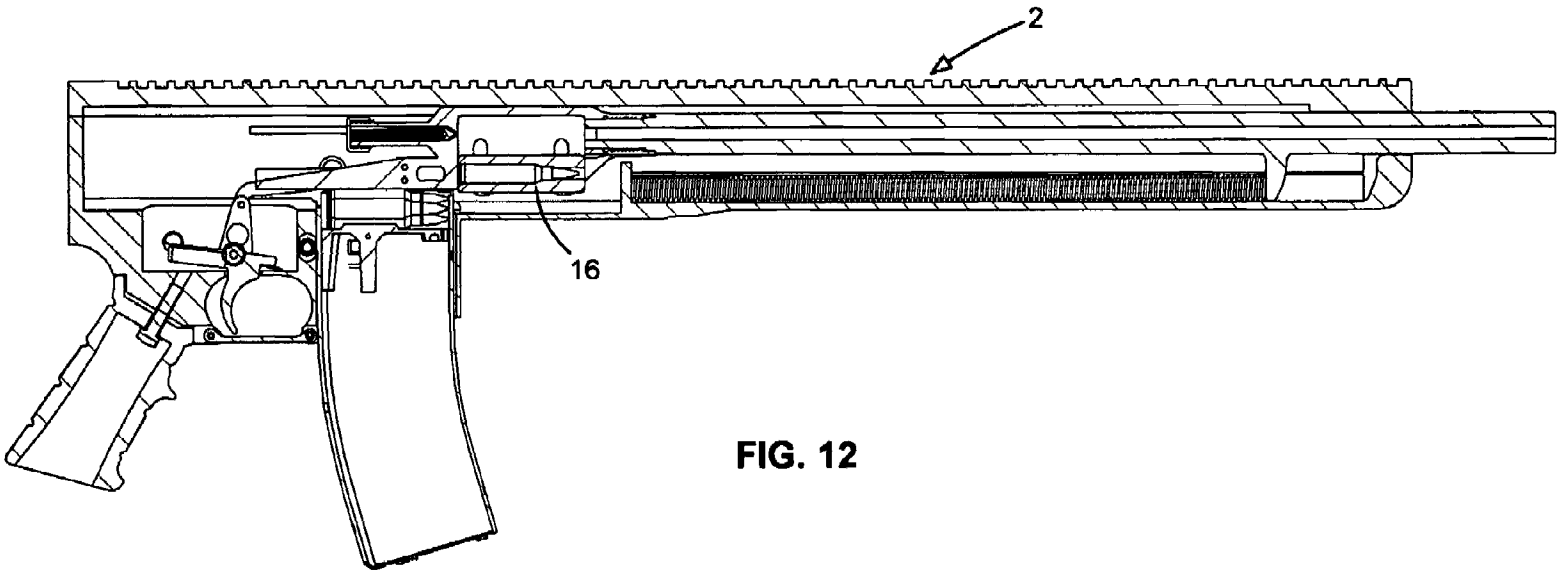
FIG. 12 is a sectional lateral view of the firearm taken on the section G—G of FIG. 11.
Figure 13:
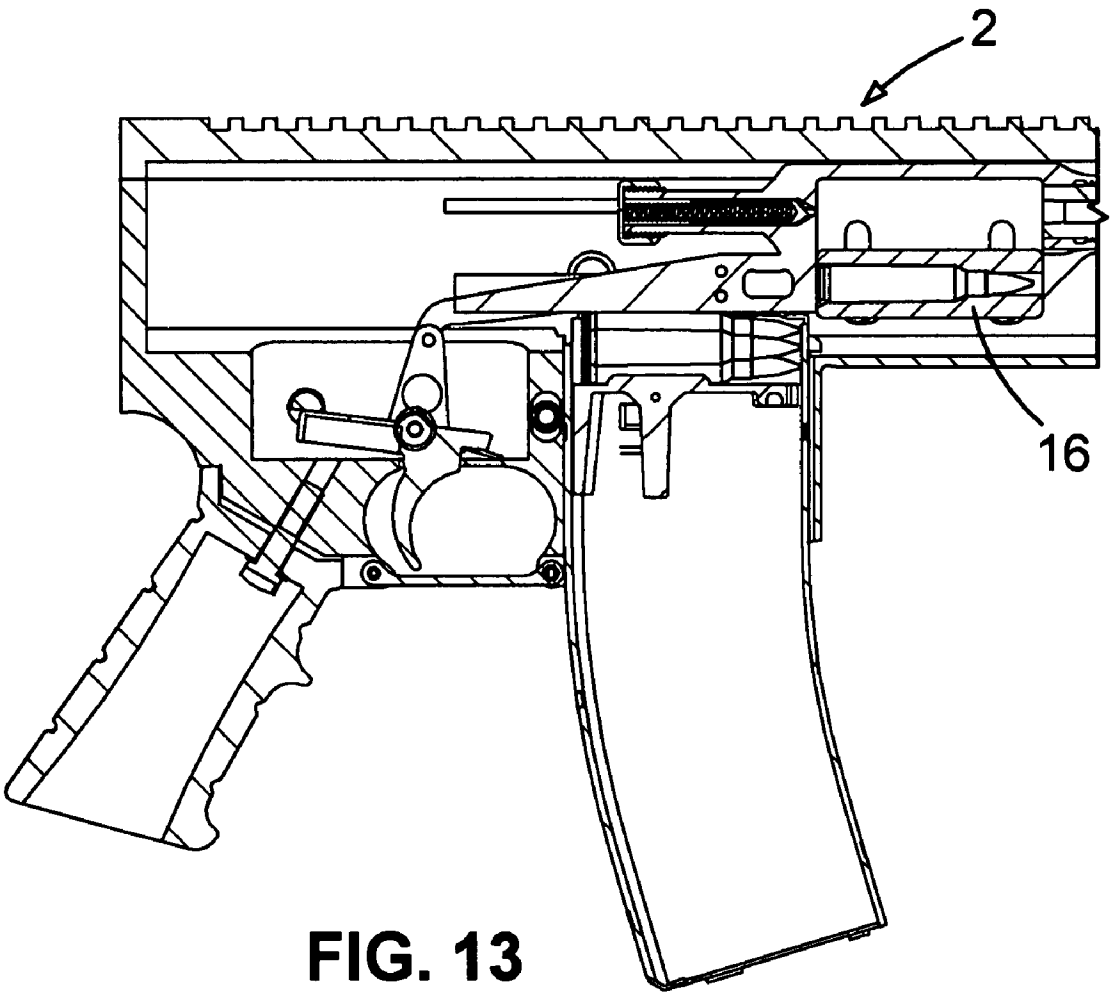
FIG. 13 is an enlarged fragmented sectional lateral view of the firearm taken on the section H—H of FIG. 11.
Figure 14:
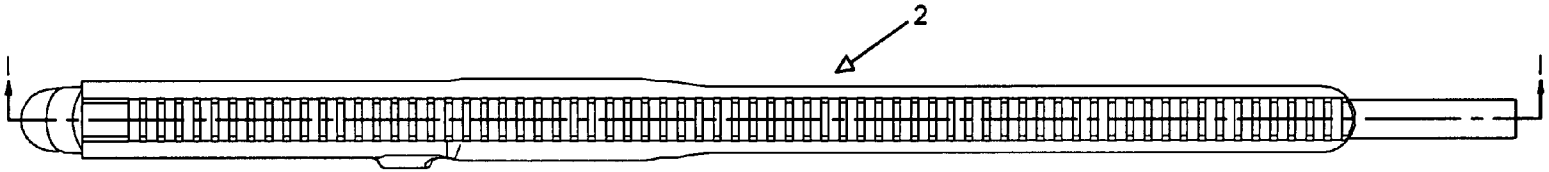
FIG. 14 is a top view of a firearm constructed in accordance with the invention with its components in position 4, i.e., the chambered round and chamber are moving up into the breech and the firing pin is engaging the striker cocking lever.
Figure 30:
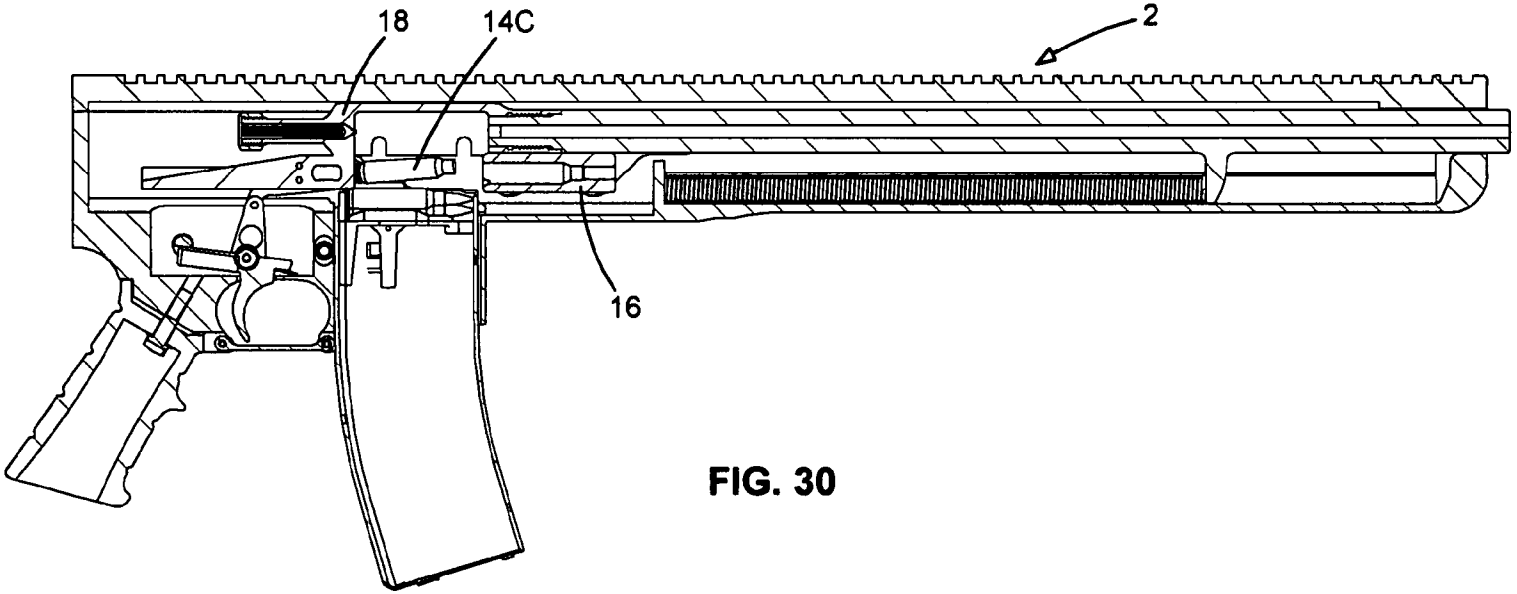
FIG. 30 is a sectional lateral view of the firearm taken on the section P—P of FIG. 29.

The new method of firing the firearm 2 in accordance with the invention comprises a unique combination of steps as illustrated by the drawings, namely:

a. separating the chamber 16 from the breech 18 (FIG. 2), b. emptying the chamber 16 of a cartridge case 14C (FIG. 30), c. loading a cartridge 14 from the magazine 12 into the empted chamber 16 (FIG. 7), d. moving the chamber 16 loaded with cartridge 14 into the breech 18 (see FIG. 15) forming an temporary operative combination 21 of the barrel 4, the breech 18 and the chamber 16 (see FIG. 21), e. causing the spring means 26 to move the temporary operative combination 21 distally along the longitudinal axis 22, f. firing the loaded cartridge 14 while the distal movement of the temporary operative combination 21 is in progress, g. compressing the spring means 26 via proximal movement of the temporary operative combination 21 resulting from the cartridge firing (see FIG. 27), and h. discharging an empty cartridge case 14C from said chamber 16 during said separation of said chamber 16 from said beech 18 (see FIG. 30).

The invention claimed is:

1. A firearm mechanism of reduced mass yet capable of long range accuracy comprising in combination, a) a barrel defined by a proximal end, a dislal end and a bore, b) a cartridge storage means for containing and dispensing cartridges, c) a chamber structured to receive cartridges dispensed from said cartridge storage means, d) a breech attached to said proximal end forming a permanent operative combination of said barrel and said breech, e) said breech being structured to operatively receive said chamber to thereby provide an temporary operative combination of said barrel, said breech and said chamber, f) a receiver mounting said permanent operative combination for movement along a longitudinal axis between a proximal extremity and a distal extremity, g) transport means carried by said receiver to move said chamber into said breech while said permanent operative combination moves along said longitudinal axis toward said distal extremity thereby creating said temporary operative combination and to move said chamber out of said breech while said temporary operative combination is in motion along said longitudinal axis toward said proximal extremity, h) spring means structured to bias said permanent operative combination distally along said longitudinal axis and to be compressed by proximal movement of said permanent operative combination and i) trigger means to cause discharge of chambered cartridges with a predetermined delay after movement of said temporary operative combination toward said distal extremity has commenced.

2. The firearm mechanism of claim 1 wherein said cartridge storage means is a magazine.

3. The firearm mechanism of claim 1 wherein said transport means comprises a cam.

4. The firearm mechanism of claim 1 that comprises a striker.

5. The firearm mechanism of claim 1 that comprises a scar and a breech sear.

6. The firearm mechanism of claim 1 that comprises a cartridge case ejector.

7. A firearm mechanism comprising in combination, a barrel defined by a proximal end, a distal end and a bore, a breech attached to said proximal end forming an operative combination of said barrel and said breech, a receiver mounting said operative combination for movement along a longitudinal axis between a proximal extremity and a distal extremity, a chamber structured to chamber cartridges, and transport means carried by said receiver to move said chamber into said breech while said operative combination is in transit from said proximal extremity to said distal extremity and to move said chamber out of said breech while said operative combination is in transit from said distal extremity to said proximal extremity.

8. A method of firing an automatic or semi-automatic firearm comprising a cartridge storage means containing cartridges, a spring means, a chamber, a barrel, a breech attached to said barrel and structured to operatively receive and release said chamber, said method comprising the following combination of steps, a. separating said chamber from said breech, b. emptying said chamber of a cartridge case, c. loading a cartridge from said storage means into said empted chamber, d. moving said cartridge loaded chamber into said breech forming a temporary combination of said barrel, said breech and said chamber, e. causing said spring means to move said temporary combination distally along a longitudinal axis, f. firing said cartridge while said distal movement of said temporary combination is in progress, g. compressing said spring means via proximal movement of said temporary combination resulting from said firing of said cartridge, and h. discharging an empty cartridge case from said chamber after said separation of said chamber from said breech.

9. The method of claim 8 wherein said chamber moves laterally of said breech and said breech moves distally of said chamber during said separation of said chamber from said breech.

* * * * *